US008167137B2

(12) United States Patent
Osiensky et al.

(10) Patent No.: US 8,167,137 B2
(45) Date of Patent: May 1, 2012

(54) APPARATUS FOR TEXTILE COUNTING, SORTING AND CLASSIFYING SYSTEM

(75) Inventors: Brant R. Osiensky, Colville, WA (US); David Rinella, Kansas City, MO (US); Gerald W. Pelissier, Marcus, WA (US); Scott McMillan, Colville, WA (US)

(73) Assignee: Colmac Indutries, Inc., Colville, WA (US)

( * ) Notice: Subject to any disclaimer, the term of this patent is extended or adjusted under 35 U.S.C. 154(b) by 286 days.

(21) Appl. No.: 12/702,237

(22) Filed: Feb. 8, 2010

(65) Prior Publication Data

US 2010/0138034 A1 Jun. 3, 2010

(51) Int. Cl.
*B07C 1/00* (2006.01)

(52) U.S. Cl. ..... 209/657; 209/551; 209/552; 209/937; 209/942

(58) Field of Classification Search ..... 209/551, 209/552, 656, 657, 937, 942
See application file for complete search history.

(56) References Cited

U.S. PATENT DOCUMENTS

| | | | | |
|---|---|---|---|---|
| 3,574,409 | A * | 4/1971 | Furstenberg | 406/3 |
| 4,013,551 | A * | 3/1977 | de Feudis | 209/606 |
| 4,344,843 | A * | 8/1982 | Leifeld | 209/143 |
| 4,849,999 | A * | 7/1989 | Humphreys et al. | 377/6 |
| 7,318,459 | B2 * | 1/2008 | Frankeberger et al. | 141/67 |
| 7,524,145 | B2 * | 4/2009 | Heinz | 406/116 |
| 7,658,292 | B2 * | 2/2010 | Osiensky et al. | 209/656 |
| 2009/0114666 | A1 * | 5/2009 | Thorpe et al. | 221/7 |

* cited by examiner

*Primary Examiner* — Terrell Matthews
(74) *Attorney, Agent, or Firm* — Polsinelli Shughart PC; Richard Stitt

(57) ABSTRACT

An apparatus is provided for transporting textile items into sorting bins with reduced energy consumption and improved load measuring accuracy and which provides textile item counting and sorting for a commercial laundry using vacuum air systems to move textiles into sorting bins and using a variable frequency drive to increase on/off response time of vacuum in the system.

3 Claims, 8 Drawing Sheets

APPARATUS FOR TEXTILE COUNTING, SORTING AND CLASSIFYING SYSTEM

CROSS REFERENCE TO RELATED APPLICATION

Priority benefit under 35 U.S.C. §120 is claimed to pending U.S. patent application Ser. No. 12/140,856, filed Jun. 17, 2008, this application claims priority under 35 U.S.C. 119(e) and 37 C.F.R. 1,78(4) based upon copending U.S. Provisional Application Ser. No. 60/936,064 for Energy Reduction Apparatus for Soiled Textile Sortation System filed Jun. 18, 2007 and the specification of which is incorporated herein by reference.

FIELD OF THE INVENTION

The present apparatus is related to the field of textile sorting machines for use in commercial laundries and the like. More particularly, the present apparatus provides a more energy efficient all suction-based textile flow pathway apparatus that allows for counting and sorting and classifying and dividing textiles into groups prior to the distribution of the textile groups about a laundry operation for further actions thereon. The apparatus further provides selectable control of the amount of suction delivered to the apparatus in response to the amount of usage the system is receiving.

BACKGROUND OF THE INVENTION

The present invention relates to the means for more efficiently transporting soiled textile items into sorting bins with reduced energy consumption and improved laundry load measuring accuracy within commercial laundry operations. These counting and sorting systems are extensively used in commercial laundries associated with the rental of linen—napkins, bar towels, table cloths and the like—to the hotel, uniform, medical and food service industry. Soiled linen counting and sorting systems, in the commercial laundry industry, typically use vacuum air systems to move textiles into sorting bins. These systems have evolved over the years but have used mechanical means to control the vacuum flow. To the extent that soiled linen counting has been employed by commercial linen cleaning operators it has been a system that was highly labor intensive, often error-prone and difficult to manage. Previously, the soiled linen items were first painstakingly separated into types of linen items such as napkins, or bar towels or table cloths then counted into separate small piles on a worktable.

This labor intensive operation has been replaced by devices that use vacuum motors to provide suction to move a group of like textile items into a temporary storage bin, placed over a moving belt. Such devices generally are similar to the device shown in FIGS. 9 and 11. Referring to FIGS. 9 and 11, to release the items onto the belt 19 below bin 17 as a sorted pile, the suction to the bin 17 is cut-off to allow gravity to drop the items to the belt 19 below. These systems use a damper or blast gate 80 (FIG. 9), operated by an air cylinder (not shown), to temporarily cut-off the suction flow generated by the fan 82 (FIG. 9) and motor 84 (FIG. 9) until the dump cycle is completed. This method of operation leaves the motor and fan generating the vacuum running during the dump cycle. It also a "dead head" state for the fan so that the fan is without any inflow to the intake. Such a "dead head" state can lead to fan and motor damage over time. Therefore, these previous devices presented the undesirable characteristics of excess noise and excess power consumption. While the blast gate is closed, the motor produces greater noise as the fan wheel cavitates and experiences excess vibration without an inlet source of air. Also, the power consumed in driving the fan wheel while the unit is in dump cycle is simply waste.

Another previous system used to move textiles from multiple sources to a singular bin of like items is commonly known as a "classifier". An additional attribute of this type of system is that it measures the amount of textiles in the bin, and determines the precise number of items to be dumped into a wash container to achieve a particular volume for the intended wash wheel or compartment for which it is destined.

Such "classifier" systems have used three different methods to deliver the textiles to the correct bin. One method uses a vacuum motor or fan to provide suction for an initial lift stage that takes the textile into the tube and lifts it some height. A second stage then employs the exhaust side of the vacuum motor or fan to push the textile down a another tube toward a set of diverting doors. These diverting doors direct the goods to the correct bin. A drawback with this system is the need for high power requirements to generate sufficient suction to operate each tube being operated in the whole of the system. Typically, 15 HP is required for each 6" diameter sort tube for a six (6) tube system 90 HP would be needed to operate the system. Further, in this type of system it is typical that each tube would have air flow or suction supplied by a separate motor. These multiple motors and fans substantially increase system complexity and noise.

Another prior "classifier" system design uses multiple sets of motors in a common plenum to create suction for all bins. In this system each tube gets suction from an open connection to one of the bins. In this system design the inlets are vertical in nature and significant power is required to provide enough suction. Typically, 60 HP is required for (8) 4" tubes. The system is also practically limited to 4" diameter tubes, whereas 6" diameter has greater compatibility with larger textile items, such as table tops or bed sheets.

Yet another system uses a blowing motor to simply push the goods down a tube toward a set of diverting dampers. These dampers then direct the goods to the bin. This system is limited in application as there is no provision to lift and take away the textiles, that is, the textiles must be dropped via gravity or some other mechanism into the tube.

There for it would be a benefit if a textile sorting and distribution system were available that reduced the number of motors and fans needed to cause flow of the textile through a pathway and into sorting bins.

It would be another benefit if such a textile sorting and distribution system were available that could avoid the need to cause "dead head" states in the motor and fan thereby reducing the wear and tear on the motors and fans providing the flow of the textile through a pathway and into sorting bins, Yet another benefit would be attained if such a textile sorting and distribution system were available that could selectably adjust the motor and fan energy requirements and amount of generated suction or air flow generated by the fan to match the number of sorting tubes being employed at any determined time.

Still another benefit would be attained if such a textile sorting and distribution system were available that could avoid the need to start and stop the vacuum or air flow or suction to permit the unloading of textile items from the sorting bins.

These objects and advantages and others will become apparent from the following detailed description of the embodiments read in conjunction with the accompanying drawings. The detailed description and drawings are merely illustrative of the present invention rather than limiting, the scope of the present invention being defined by the appended claims and equivalents thereof.

SUMMARY OF THE INVENTION

The first counting/sorting portion of the system does not use the damper or blast gate 80 (FIG. 9) method for controlling vacuum to the bin. A variable frequency drive unit (VFD) 62 (FIG. 10) having a brake 25 (FIG. 10) is used to quickly start and stop the motor 26 to control vacuum generated by fan 24. When the dump cycle from the sorting bin is initiated, the VFD shuts down the motor very quickly to eliminate all suction and allow the goods to drop. The braking mechanism 25 is employed to stop the motor even more quickly. This allows the system to save electrical power while the system is in dump mode. Also, the system controls the motor so that during non-sorting operations (when textiles are not actively being delivered) the motor is off, unlike previous systems where the motor was more or less operating continuously for an entire work shift. During this downtime, the laundry is spared from unnecessary noise as well. When counting/sorting resumes, the motor is ramped up to speed with a gradual curve, to avoid large current inrush, which could trigger "Demand" charges by some electric utility providers.

The second, "classifier" portion of the system overcomes the high power requirements of previous systems. The system uses the vacuum side of the motor(s) for all bins, but has unique design advantages. In order for a bin to create suction, but not self-plug the inlet with the textiles themselves, prior systems required either large internal volumes, or baffles that restricted flow, thus increasing power requirements. The present sorting system uses a cyclonic principle in which the textile goods, or workpiece, enter a cone-shaped bin at high velocity. In the cone-shaped bin the workpiece travels in a spiraling motion whereupon the velocity is dissipated and the workpiece falls to the bottom of the bin away from the suction inlet.

A further aspect of the device is the use of diverter tubes which send the goods to the respective bins. In the prior art, diverters were either simple damper doors that directed goods to fall one way or the other, due to simple deflection. Or, in vacuum based systems, a blast gate at the inlet of the bin was used. In the blast gate example, the bypass line would remain open. This caused an undesirable problem: "blow-by", where the goods would not slow and direct to the desired bin, but coast on past the inlet. To compensate, holes at the end of the suction line would need to be left open, to create a small amount of "back suction", to ensure air and the goods would flow into the gate. The diverters of the present embodiment create a true two-state switch. When no workpiece is in a particular tube as indicated by the operator selection and the counting software, the tube is devoid of suction. When the tube is selected, it then is actively connected to, and only to, one sorting bin and suction is thereby applied to the tube. There is no open path to bypass.

Another aspect of the device is the angle of the inlet to the cyclonic bins. The cyclonic sorting bins are inverted cones which receive the sorted textile workpieces. In the prior art, the inlets required an upward, against gravity, path to the bin. Also, the previous path was a 180 degree turn from upward to downward motion into the bin.

One present embodiment has a gradually downward path of the receiving arm into the cyclonic bin. This reduces the suction requirement to move the textile goods. The inlet angle of the receiving arm to the sorting bin, is generally in a tangential alignment to the side of the cone. This is the beginning of the circular vortex path of the textile item within the sorting bin during which the textile item falls out of the suction path and drops toward the conical sorting bin apex.

Another aspect of the cyclonic vortex bin is the suction motor control. Similar to the conventional bin previously described, the motor can be controlled by a variable frequency drive unit (VFD). The benefits of stopped operation when there is no suction demand, and gradual start-stop of the motor for avoiding utility ("Demand") charges are realized. The system also uses a monitoring control to determine the number of suction tubes in operation. When fewer tubes are in operation, the operational rate of the motor can be correspondingly reduced, saving energy and optimizing the suction necessary. When the number of tubes in use is larger, or at maximum for the system size, the flow rate can be increased, optimizing the necessary suction. Thus the required energy can be matched to the suction needed.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DETAILED DESCRIPTION

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
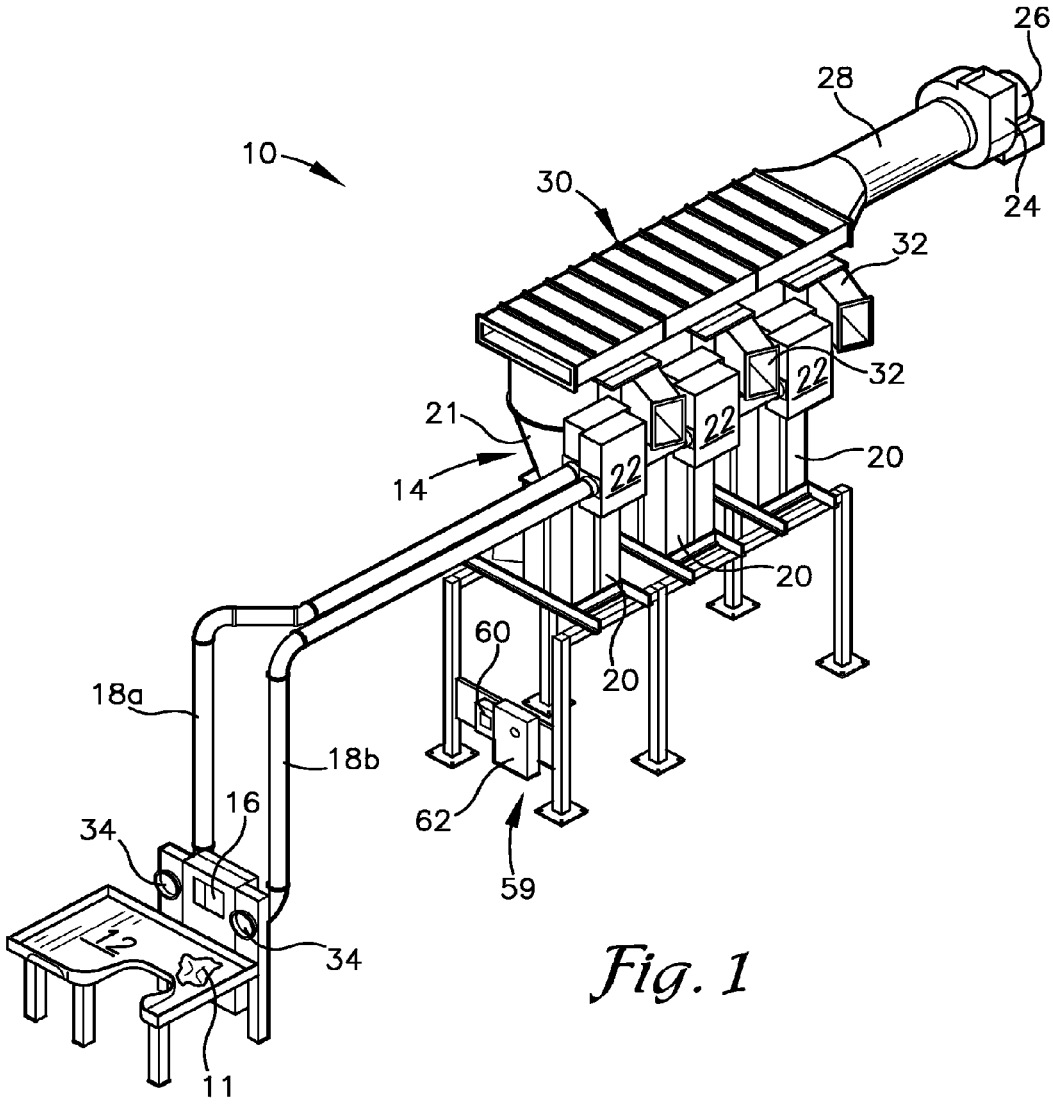
FIG. 1 is a perspective view of an embodiment of the apparatus 10 showing the interconnection of the various components of an embodiment of the apparatus having a sorting table 12 at a first end of the apparatus and a motor 26 and a fan 24 operated said motor at a second end of said apparatus.

First referring to FIG. 1, a perspective top and right side view of the overall apparatus 10 is shown. The structure of the apparatus 10 will now be described in the sequence that a textile article or workpiece 11 would take in passing through the apparatus 10. The soiled textile is first deposited onto a soil counting table or work table 12 where an operator sorts the workpiece from other textile workpieces and determines which sorting bin 14 the particular selected textile should be directed toward. The operator (not shown) then examines the options presented on operator selection panel 16 to select the proper sorting bin 14 to which the textile is to be deposited. Operator selection panel 16 provides, in this embodiment, three possible sorting bin 14 selections for each of flow tubes 18*a*, 18*b*. In the embodiment shown in FIG. 1, three sorting bins 14 are presented in general linear array, and each sorting bin 14 is provide with a collection bin 20 which resides at the bottom of a cyclonic cone 21. A suitable touch screen display for use as operator selection panel 16 is the model ELO ET1537L-80WA-1-G manufactured by Elo TouchSystems, Inc. of Menlo Park, Calif. and which is controlled by computer controller 60.

The operator at work table 12 retrieves a textile item or a workpiece such as a napkin from a pile of pieces to be sorted on work table 12 and then examines the options on screen 16 to determine the bin selection for the item selected. The operator then makes the selection on selection panel 16 for either of flow tubes 18*a*, 18*b* into which the operator will deposit the workpiece. When the operator selects the particular sorting bin 14 into which the workpiece is to be deposited, the series of diverters 22 which are set in sequential fashion along the length of flow tubes 18*a*, 18*b* are switched to permit the workpiece that is introduced into a flow tube 18*a*, 18*b* to be deposited into the correct sorting bin 14 that the operator selected on selection panel 16. The specific operation of diverters 22 will be discussed hereinafter.

When the textile or workpiece 11 is introduced into flow tube 18*a*, 18*b*, it is pulled through flow tube 18*a*, 18*b* by the suction of a reduced pressure which is created in flow tube 18*a*, 18*b*, and the system in general, by vacuum fan 24 which is operator by motor 26. Motor 26 is provided with a variable-frequency drive, the operation of which and the effect on the apparatus 10 will be described hereinafter.

Figure 10:
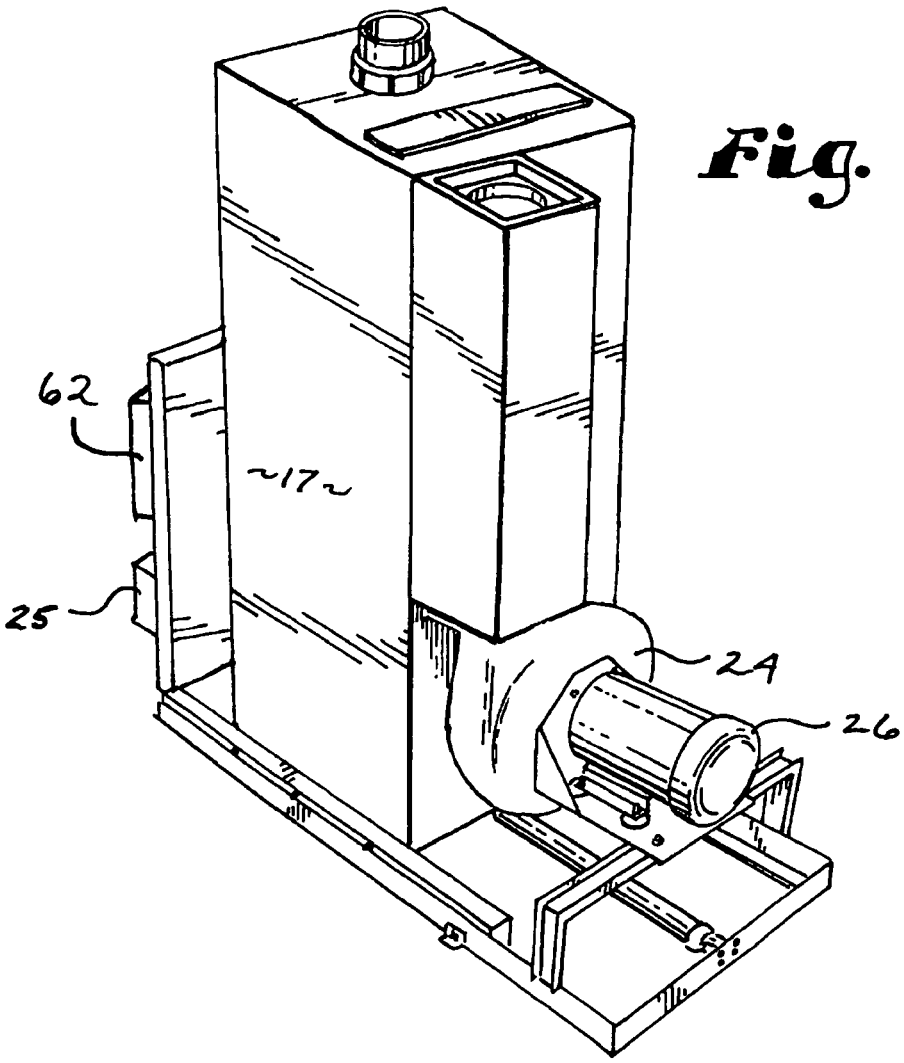
FIG. 10 shows an embodiment of a counter/sorter having the dump or blast gate 80 eliminated and the interruption of the suction being generated by fan 82 and motor 84 being governed by use of a variable frequency drive control 62 and a brake 25.
Figure 11:
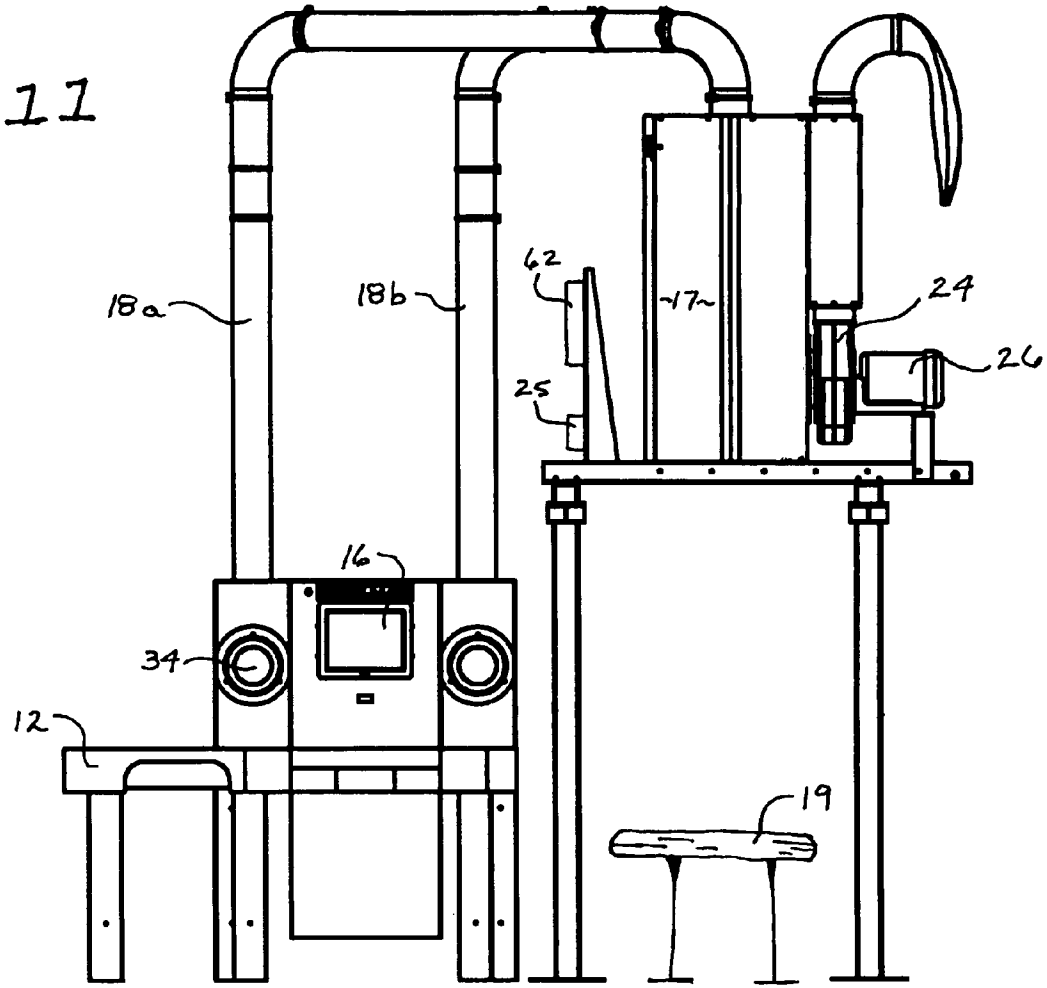
FIG. 11 shows a side elevation view of a sorting table and flowtubes leading to a counter/sorter of FIG. 10 that is governed by use of a variable frequency drive control 62 and a brake 25 and in which the variable frequency drive control is a Powerflex 40 240VAC 22B-B017N104 and the brake is a AK-R2-030P1K2 brake resistor.manufactured by the Allen Bradley division of Rockwell Automation of Milwaukee, Wis.

The operation of fan 24 by motor 26 generates an air flow, or vacuum air flow as it is commonly referred, within vacuum connection tube 28 which is connected to vacuum distribution duct 30. The low pressure created by vacuum fan 24 is thereby communicated to the remainder of the system including cyclonic cones 21 and receiving arms 32 which are attached to cyclonic cone 21. In this manner, a directional air flow is created throughout the entirety of apparatus 10 which permits the operator at work table 12 to rapidly direct selected textile workpieces through either of flow tubes 18*a*, 18*b* and into the plurality of sorting bins 14. The operator can, through proper switching of diverters 22 at selection panel 16, select the proper sorting bin 14 for the workpiece 11. The processing unit controller 60 of the apparatus 10 then automatically orients the sequence of diverters 22 on the selected flow tube 18*a*, 18*b* to result in the depositing of the workpiece 11 into the selected sorting bin 14 once the workpiece is introduced into the mouth 34 of the selected flow tube 18*a*, 18*b*. For the embodiment shown in FIG. 1, a suitable fan is Model HDAF or HDBI manufactured by Cincinnati Fan and Ventilator Company, Inc., of Mason, Ohio. For the embodiment shown in FIGS. 10 and 11, a suitable fan is Model PB-14 manufactured by Cincinnati Fan and Ventilator Company, Inc., of Mason, Ohio.

Figure 2:
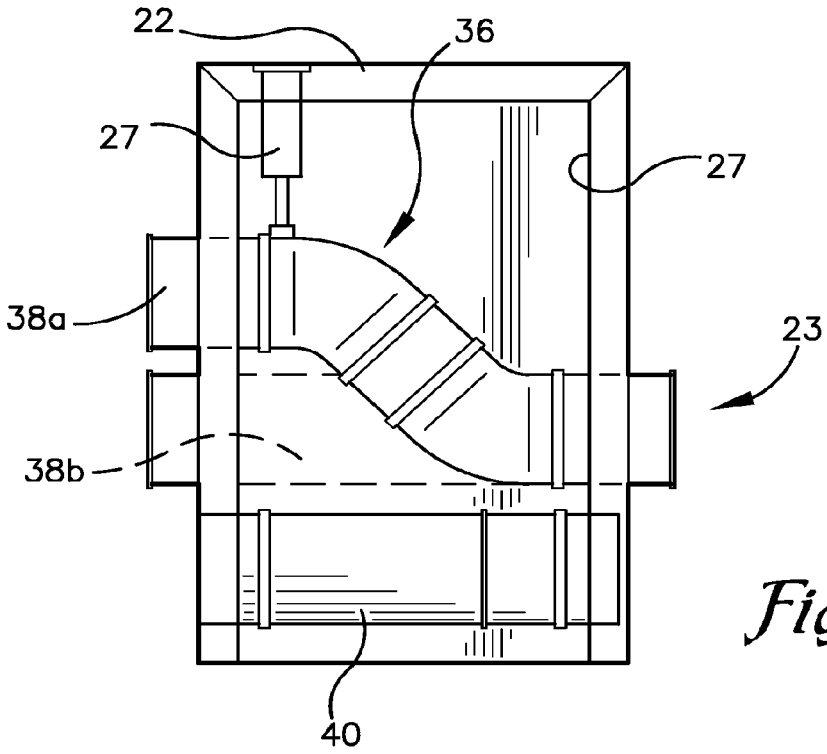
FIG. 2 is a side elevation view of a diverter 22 with the side panel of the diverter housing removed to show diversion tubes 36 and 40 which are selectably positionable between a first position 38*a* and a second position 38*b* to connect either diversion tube 36 or 40 to inlet 23.

Referring now to FIG. 2, the operation of the diverters 22 will be described. Each diverter 22 is comprised of a housing which contains, generally, a diversion tube 36, 40 that can be selectably positioned between a first exit position 38*a* and a second exit position 38*b* to achieve the selection of a path of travel of a workpiece 11 through the apparatus. This selection of the diversion tube positions is made by the operator at panel 16 and allows the operator to select a pathway through tubes 18 that will lead a workpiece 11 to the particular sorting bin 14 into which the workpiece 11 is to be placed. In a preferred embodiment, two diversion tubes 36 and 40 are used together and shift position in tandem between a first exit position 38*a* and a second exit position 38*b* to direct the path taken by textile articles or workpieces 11 through the apparatus to reach the operated selected sorting bin 14. It can be appreciated that additional selectable diversion tube positions could be added to the diverter 22 in an alternate embodiment.

Figure 3:
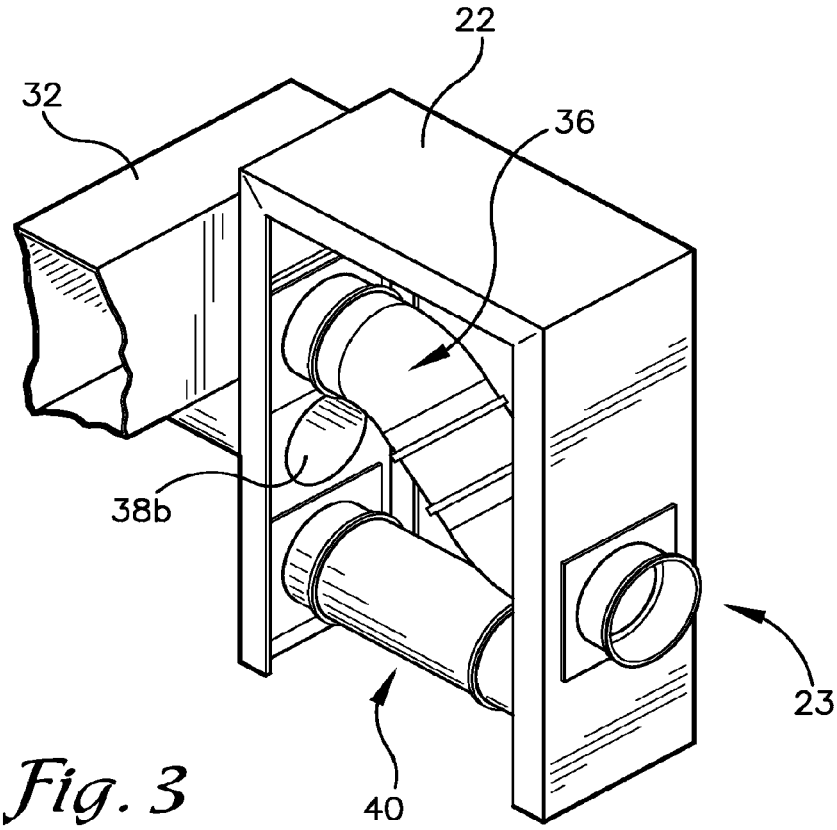
FIG. 3 is a side and front view of the diverter 22 of FIG. 2 with the side panel of the diverter housing removed and with receiving arm 32 included to show diversion tube 36 in position 38*a* to deliver textile items into receiving arm 32 from inlet 23.

Referring now to FIGS. 2 and 3, diverters 22 have a single inlet position 23 used by both diversion tubes 36, 40 to receive a workpiece 11 from tube 18 that leads to inlet 23. Diverters 22 have two exit positions 38*a*, 38*b*. Only one exit position ever is active and this depends on which of diversion tubes 36 or 40 is in position to receive a workpiece from inlet 23. A first exit position 38*a* sends the workpiece 11 into receiving arm 32 and into a particular sorting bin 14 which was selected for the workpiece 11 by the operator at selection panel 16. A second position 38*b* sends the workpiece 11 past receiving arm 32 (FIG. 3) and onto a different diverter 22 or to another pathway. In operation of a preferred embodiment of the apparatus, the operator makes the desired pathway selection at selection panel 16. A means for shifting 27 (FIG. 2) diversion tubes 36, 40, such as a pneumatic cylinder, is activated by the operator's selection and diversion tubes 36, 40 shift up or down, in tandem, to position either the inlet end of diversion tube 36 or the inlet end of diversion tube 40 in front of inlet 23 of diverter 22 (FIG. 2). This selectable positioning allows the workpiece 11 introduced into the flow tube 18 by the operator to be directed into one of two paths by diverter 22.

If the inlet end of diversion tube 36 is positioned in front of inlet 23 then the workpiece 11 will be directed through diversion tube 36 and sent out first exit position 38*a* to send the workpiece 11 into receiving arm 32 (shown in fragmentary view in FIG. 3). If the inlet end of diversion tube 40 is positioned in front of inlet 23 then the workpiece 11 will be directed through diversion tube 40 and sent out second exit position 38*b* to send the workpiece 11 into a different diverter 22 and different receiving arm 32 or into another pathway.

As may be observed by inspecting FIG. 3 and FIG. 1, in apparatus 10, each receiving arm 32 is connected to one of sorting bins 14 and to a diverter 22 for each tube 18 that is intended to direct workpieces 11 to a particular sorting bin 14. The workpiece, upon entering receiving arm 32, travels down receiving arm 32 and into the selected sorting bin 14 which the operator previously selected at selection panel 16. It further will be appreciated that the selectable shifting, or selectable movement of the diversion tubes 36 and 40 within diverter 22 can be mechanically operated by a number of alternate means. A means for shifting 27 (FIG. 2) may be comprised of a pneumatically or hydraulically motivated arm or piston or a solenoid can be employed by those skilled in the art to achieve the movement of diversion tubes 36 and 40 between the first and second positions 38*a*, 38*b* for the selectable repositioning of diversion tubes 36 and 40. Alternatively, a motorized gear mechanism could be employed to shift the diversion tubes 36 and 40 to orient the desired diversion tube 36 or 40 inlet in front of inlet 23.

Figure 8:
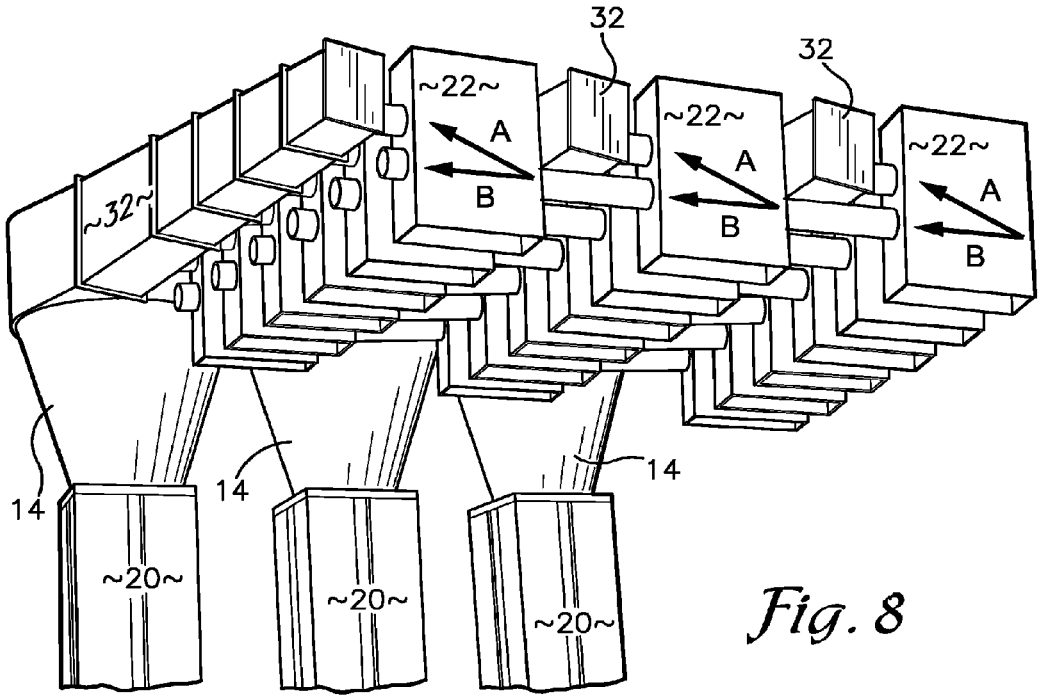
FIG. 8 shows the receiving arms 32 connected to the sorting bins 14 and shows with an Arrow "A" the active position in which vacuum or suction is provided to the tube 18 to draw a textile or workpiece into the receiving arm 32 and shows an Arrow "B" indicating the non-active in which a textile or workpiece passes through a diverter 22 on the way to another diverter 22 and receiving arm 32 of different sorting bin 14 and the figure shows that when a series of diverters 22 all are in the "B" position that no vacuum or no suction is provided to the tube 18 of the apparatus thereby saving the energy of providing suction to that particular tube 18.
Figure 9:
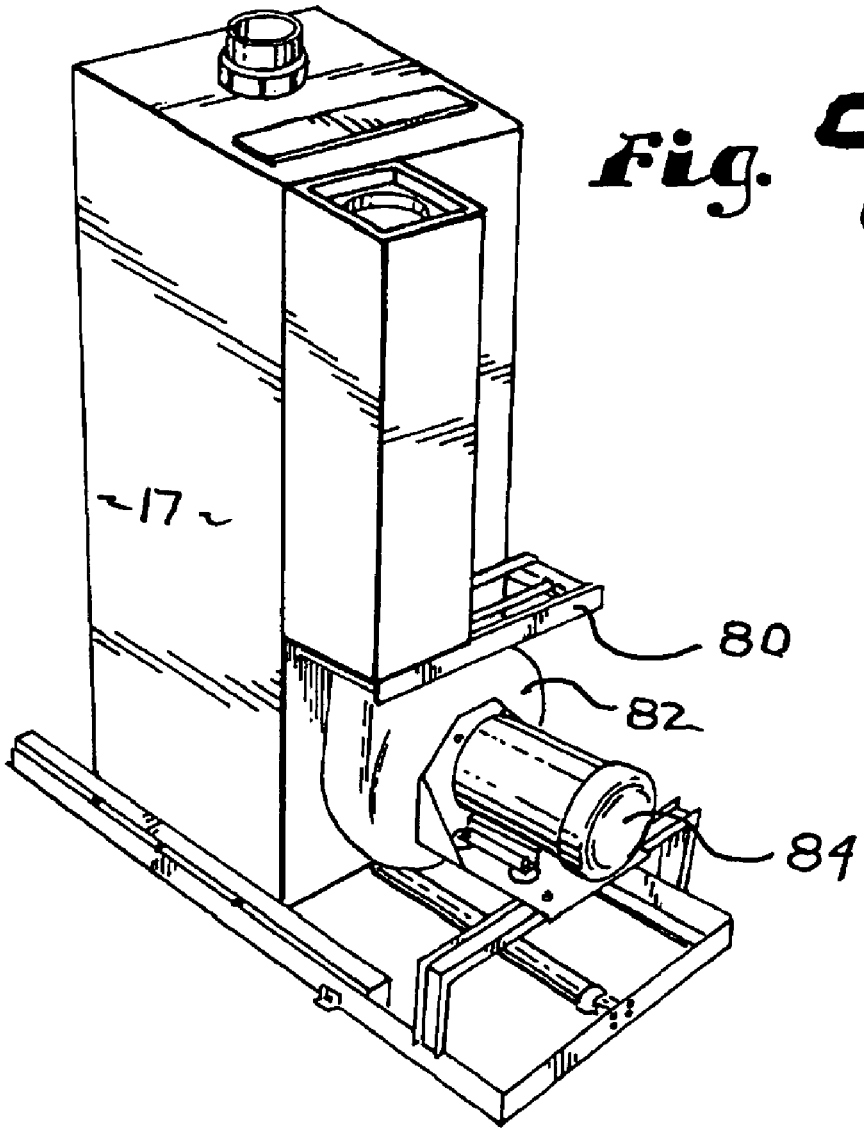
Fig. 9 PRIOR ART
FIG. 9 a prior art counter/sorter having a dump or blast gate 80 to interrupt the suction being generated by fan 82 and motor 84.

Referring now to FIG. 8 the features of diverters 22 will be further discussed. As is shown in FIG. 8 receiving arms 32 are connected to sorting bins 14 and diverters 22. The selectable shifting of diversion tubes 36, 40 within diverters 22 is indicated by arrows as providing two pathways. When diversion tube 36 is in use the pathway shown by Arrow "A" is the active position and vacuum or suction is provided to the tube 36, and in turn also to the associated tube 18. This application of suction draws the textile or workpiece 11 through diversion tube 36 from the associated tube 18 and into the receiving arm 32. When a diversion tube 40 is in use the pathway shown by Arrow "B" is the active position. In this position a textile or workpiece 11 passes through diverter 22 on the way to another diverter 22 and receiving arm 32 of different sorting bin 14. Also, when all of the diversion tubes 40 of a flow tube 18 all are in the Arrow "B" position no vacuum or no suction is provided to the particular tube 18 of the apparatus as the tube 18 then has no connection to the vacuum or suction source which is provided by a connection to on of receiving arms 32. This ability to selectably eliminate the application of vacuum or suction to a particular tube 18 provides an energy savings by the apparatus.

A particular feature of the apparatus 10 is the use of variable frequency drive control 60 (FIG. 1) to operate the fan motor 25 in providing the suction or air flow with in the flow pathway that is the motive force for moving the textile workpieces 11 through the flow pathway. The flow pathway, generally, comprising tubes 18 and diversion tubes 36, 40 and receiving arm 32 and sorting bin 14. The benefit to the use of the variable frequency drive control is that the fan, and therefore the suction or air flow in the flow pathway, can more rapidly be controlled. The fan 24 (FIG. 1) rapidly can be started and stopped and operated at selectable speeds depending on the number of tubes 18*a*, 18*b*, (FIG. 1) being used at any particular time. In this way the apparatus is made more energy efficient and the noise level of the apparatus, and the workplace, can be reduced. In one embodiment, a brake 25 (FIGS. 10 & 11) also is employed on motor 26 to assist in rapidly changing the speed of fan 24.

Alternating-current electric motors run at speeds closely determined by the number of poles in the motor and the frequency of the alternating current supply. This is unlike the steam engine, which can be made to run over a range of speeds by adjusting the timing and duration of valves admitting steam to the cylinder. AC motors can be made with several sets of poles, which can be chosen to give one of several different speeds (say, 720/1800 RPM for a 60 Hz motor). The number of different speeds available is limited by the expense of providing multiple sets of windings. If many different speeds or continuously variable speeds are required, other methods are required. Direct-current motors allow for changes of speed by adjusting the shunt field current. Another way of changing speed of a direct current motor is to change the voltage applied to the armature.

An adjustable speed drive might consist of an electric motor and controller that is used to adjust the motor's operating speed. The combination of a constant-speed motor and a steplessly adjustable mechanical speed-changing device might also be called an adjustable speed drive. Electronic variable frequency drives are rapidly making older technology redundant. Process control and energy conservation are the two primary reasons for using an adjustable speed drive. Historically, adjustable speed drives were developed for process control, but energy conservation has emerged as an equally important objective. An adjustable speed drive often uses less energy than an alternative fixed speed mode of operation. Fans and pumps are the most common energy saving applications. When a fan is driven by a fixed speed motor, the airflow may sometimes be higher than it needs to be. Airflow can be regulated by using a damper to restrict the flow, but it is more efficient to regulate the airflow by regulating the speed of the motor. Adjustable-frequency drives (AFD) control the speed of either an induction motor or a synchronous motor by adjusting the frequency of the power supplied to the motor. Adjustable frequency drives are also known as variable-frequency drives (VFD).

A variable frequency drive control is essentially an electronic power conversion circuit. The conversion circuitry first converts the input AC power to DC intermediate power using a rectifier or rectifier bridge. The DC intermediate power is then converted to a quasi-sinusoidal AC power, at the desired frequency using inverter switching circuitry. The motor used in a VFD system is usually a three-phase induction motor. Some types of single-phase motors can be used, but three-phase motors are usually preferred. Various types of synchronous motors offer advantages in some situations, but induction motors are suitable for most purposes and are generally the most economical choice. Motors that are designed for fixed-speed supply voltage operation are often used, but certain enhancements to the standard motor designs offer higher reliability and better VFD performance.

AC motor characteristics require the applied voltage to be proportionally adjusted whenever the frequency is changed in order to deliver the rated torque. For example, if a motor is designed to operate at 460 volts at 60 Hz, the applied voltage must be reduced to 230 volts when the frequency is reduced to 30 Hz. Thus the ratio of volts per hertz must be regulated to a constant value (460/60=7.67 V/Hz in this case). For optimum performance, some further voltage adjustment may be necessary, but nominally constant volts per hertz is the general rule. This ratio can be changed in order to change the torque delivered by the motor. An embedded microprocessor governs the overall operation of the VFD controller. The main microprocessor programming is in firmware that is inaccessible to the VFD user. However, some degree of configuration programming and parameter adjustment is usually provided so that the user can customize the VFD controller to suit specific motor and driven equipment requirements. In addition to manual control of the motor speed, the controller circuitry for a variable frequency drive may alternatively be controlled by signals from external processes.

Figure 5:
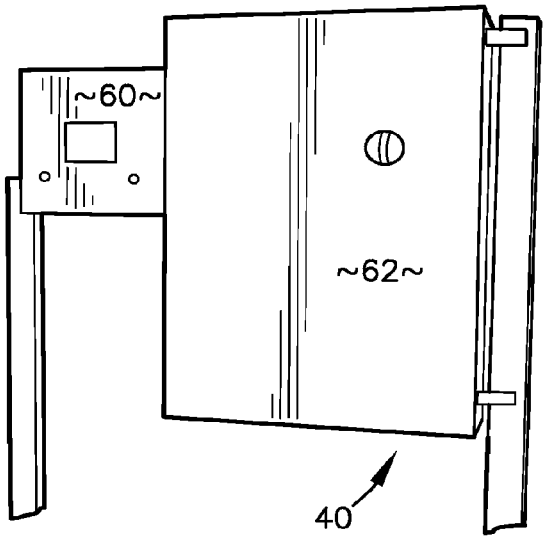
FIG. 5 is a view of the apparatus control panel 59 showing the housing for variable frequency drive control 62 for motor 26 and the housing for computer controller 60 for the apparatus 10.
Figure 7:
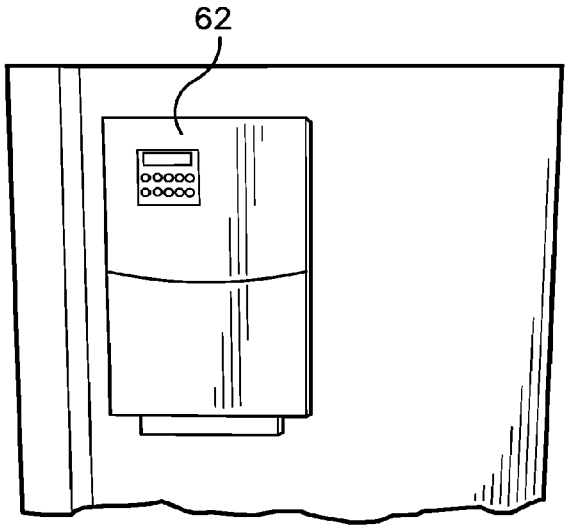
FIG. 7 shows an interior view of variable frequency drive control 62 for apparatus 10.

Referring now to FIGS. 5 and 7, in the present apparatus 10 the variable frequency drive control 62 is employed to selectably change the fan speed and therefore the amount of generated suction in the flow pathway, depending on the number of tubes 18*a*, 18*b* in use. For the apparatus shown in FIGS. 10 and 11, a suitable variable frequency drive control 62 is the Powerflex 40 240VAC 22B-B017N104 with a AK-R2-030P1K2 brake resistor manufactured by the Allen Bradley division of Rockwell Automation of Milwaukee, Wis. For the apparatus shown in FIG. 1 a suitable variable frequency drive control 62 is the DURApulse GS3-2050 manufactured by the Automation Direct of Atlanta, Ga.

Figure 4:
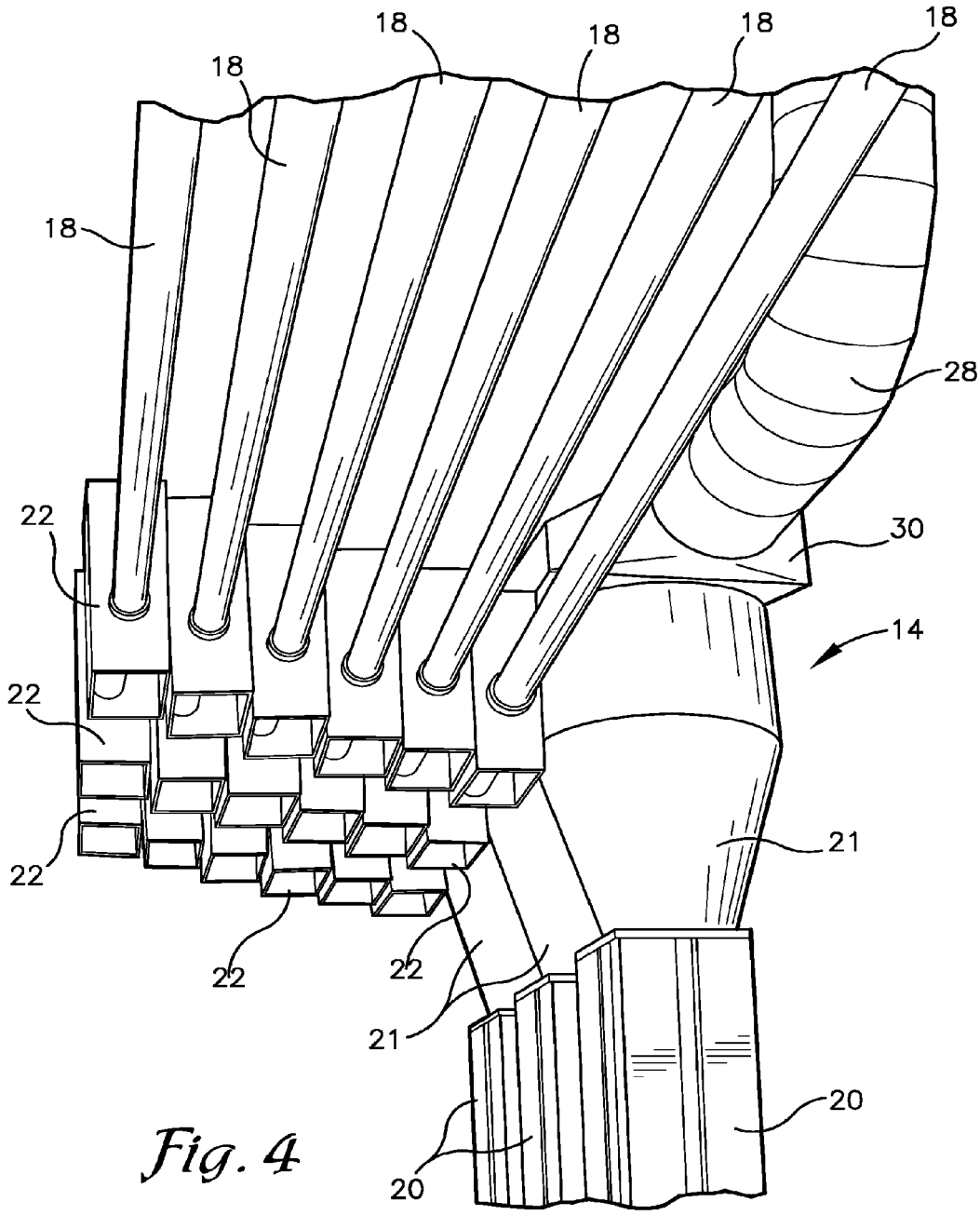
FIG. 4 is a front and bottom perspective view of a portion of an embodiment of the apparatus showing the sorting bins 14 having cones 21 and the cylindrical extension extending from the cone and an holding bin 20 at the apical end of the cone 21.

During the operation of the apparatus one or more tubes 18 (FIG. 4) may be in use at anytime. The more tubes in use at a time, the greater the amount of fan suction is required to produce sufficient air flow in tubes 18 to move the textile articles from table 12 to bins 14. Conversely, when only one or two tubes 18 are in use less suction is required in the apparatus. This variable need is accounted for and provided by the present apparatus with the use of the variable frequency drive control for the fan motor 26 (FIG. 1) that operates fan 24.

In particular, when the apparatus has only one (1) or two (2) tubes 18 operating, the variable frequency drive control will operate the fan motor 26 at approximately 54 Hz to produce a slower fan 24 speed and a reduced amount of suction by fan 24. When the programmable controller 60 determines apparatus 10 has three (3) to four (4) tubes 18 operating, variable frequency drive control 62 is then directed by controller 60 to operate at an increased frequency and variable frequency drive control 62 will operate the fan motor 26 at approximately 58 Hz to produce a greater fan 24 speed and an increased amount of suction by fan 24. When five (5) to six (6) tubes 18 are in use the variable frequency drive control 60 will operate the fan motor 26 at 60 Hz to produce a sufficient fan 24 speed to provide sufficient suction by fan 24 to operate all six tubes. It will be appreciated that in this manner the energy consumption of motor 26 is reduced and the associated noise level in the plant also is reduced. In prior art apparatus, the motor and fan had only a single operational speed. Therefore, substantial unnecessary suction was generated by the fan when less than all of the apparatus of being used. This also provided unnecessary noise in the plant.

Figure 6:
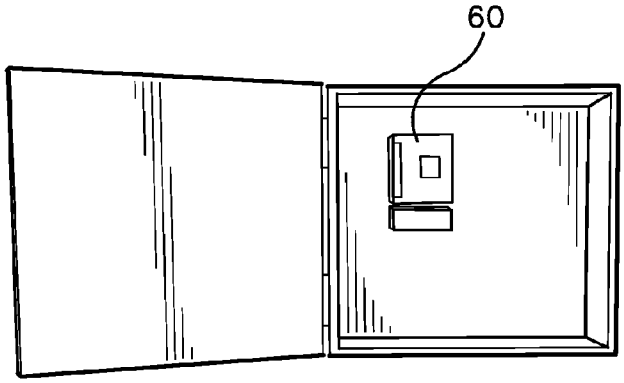
FIG. 6 is shows the processing unit 60*a* of the computer controller 60.

A programmable logic controller (PLC) or programmable controller 60 (FIG. 6) is provided to control the operation of apparatus 10 including the operator selection panel 16 and the diverters 22 responsive thereto. A suitable programmable logic controller (PLC) or programmable controller 60 is the Micrologix 1100 1763-L16BWA manufactured by the Allen Bradley division of Rockwell Automation of Milwaukee, Wis.

The variable frequency drive control 62 (FIG. 7) is responsive to the PLC controller detecting the number of tubes 18 in operation at anytime. The controller 60 detects the number of tubes 18 in use. In response to the detected number of operational tubes 18 controller 60 determines the electrical frequency to be supplied to motor 26 by the variable frequency drive control 62. As previously described, this variation in electrical frequency provided to motor 26 results in a change in fan 24 speed. This change in fan speed can rapidly be altered by the operation of controller 60 and the variable frequency drive control 62 in response to detected changes in the number of tube 18 being used at any moment. This then provides real time response of fan 24 suction generation to the operational demands of the textile cleaning plant and the apparatus 10. In FIG. 1, programmable controller 60 and variable frequency drive control 62 are located new bins 14 on control panel 40.

The programmable controller 60 also monitors the counts of textile pieces or work pieces from the sorting stations 12 to determine when to dump the accumulated textile pieces or work pieces from one of the holding bins 20 at the apical end of the cone 21.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described. Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive apparatus for textile sorting is constructed and used, the characteristics of the construction, and advantageous, new and useful results obtained; the new and useful structures, devices, elements, arrangements, parts and combinations, are set forth in the appended claims. It is also to be understood that the following claims are intended to cover all of the generic and specific features of the invention herein described, and all statements of the scope of the invention which, as a matter of language, might be said to fall therebetween.

Having thus described the invention what is claimed as new and desired to be secured by Letters Patent is as follows:

1. An apparatus for sorting textile workpieces comprising:

an enclosed workpiece flow pathway comprising, a tube having a mouth for receiving a textile workpiece into said flow pathway, a diverter connected to said tube, said diverter having at least first and second exit pathways from said diverter and said diverter having a selectably repositionable diversion tube for receiving a workpiece entering said diverter and said diversion tube providing selectable directing of said workpiece to at least first and second exit pathways, means for selectably repositioning said diversion tube, a receiving arm connected to one of said first and second exit pathways of said diverter, a sorting bin for receiving a workpiece from said receiving arm, said sorting bin is an inverted cone having a cylindrical section extending upwardly from said cone base and said cone having an apical portion terminating in a flat door generally covering the diameter of the cone near the apex of the cone and said receiving arm being connected in tangential arrangement to the side of said cylinder section and, a motor operated fan for generating suction airflow within said flow pathway to provide movement of said workpiece through said flow pathway said motor having a variable frequency drive control connected thereto said variable frequency drive being responsive to a programmable controller that detects the number of tubes operating in the apparatus to direct the frequency of the variable frequency drive control in response thereto, and a brake operably connected to said motor to rapidly reduce or terminate fan rotation by said motor and the suction generated by said fan in response to said variable frequency drive control.

2. The apparatus as claimed in claim 1 wherein said diversion tube is selectably repositionable by an operator from a selection panel for selectable routing of a workpiece from said tube to a selected sorting bin.

3. The apparatus as claimed in claim 2 wherein said selection panel is a programmable controller in operable connection with said means for selectably repositioning said diversion tube.

* * * * *